United States Patent [19]

Reiland

[11] 4,140,838

[45] Feb. 20, 1979

[54] SAND MOLD RISERS

[75] Inventor: Dennis J. Reiland, St. Paul, Minn.

[73] Assignee: General Foundry Products Corporation, St. Paul, Minn.

[21] Appl. No.: 922,567

[22] Filed: Jul. 7, 1978

[51] Int. Cl.[2] ..... B22C 9/08

[52] U.S. Cl. ..... 428/542; 164/362; 428/66

[58] Field of Search ..... 428/64–66, 428/137, 138, 542; 164/349, 358, 362, 363

[56] References Cited

U.S. PATENT DOCUMENTS 3,971,433 7/1976 Duchenne ..... 164/362

*Primary Examiner*—William J. Van Balen

*Attorney, Agent, or Firm*—Jacobson and Johnson

[57] ABSTRACT

A two-part mold insert for forming a riser in a sand mold with the insert having a breakable thin collar and a cellular riser material which is compressible and gasible so that hot metal dissolves the cellular riser material but not the collar which prevents molding sand from falling into the mold during the gasification of cellular riser material.

6 Claims, 3 Drawing Figures

FIG. 1
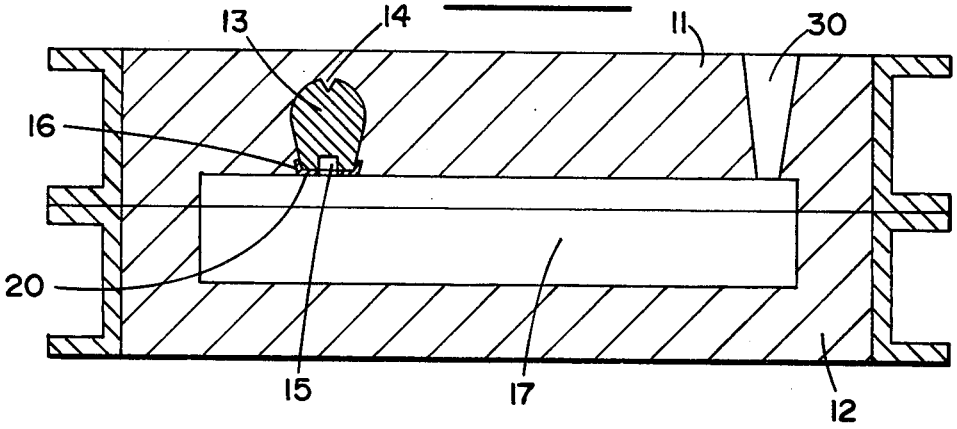
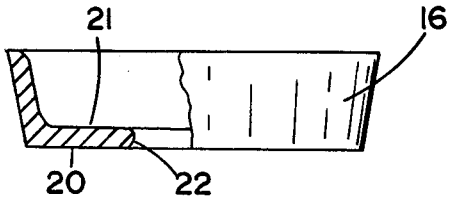
FIG. 2
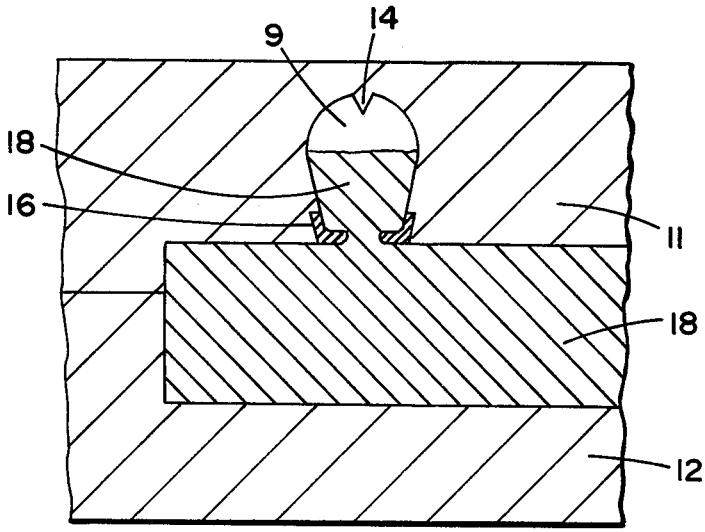
FIG. 3

SAND MOLD RISERS

BACKGROUND OF THE INVENTION

1. Field of the Invention

This invention relates generally to casting and, more particularly, to improvements in closed risers which produce a cleaner more solid casting, as well as a small contact area between the riser and the cast article.

2. Description of the Prior Art

The concept of using a stricture or collar formed between the riser and the cast article is shown in the Nieman et al U.S. Pat. No. 3,831,662. Briefly, a frangible nonfusible constricting means is placed at the juncture of the riser port and the mold cavity. The constricting means is provided with a relatively thin apertured wall which conforms to at least one dimension of the mold cavity. The wall is of sufficient thinness with respect to the high thermal conductivity of the wall material to prevent loss of heat with resultant premature cooling and hardening of the molten metal at the juncture. In the Nieman embodiment the collar is placed between the riser and the cast article where the riser extends downward below the cast article.

A second type of riser liner is shown in the Washburn U.S. Pat. No. 900,970 in which a clay pot having a construction is used as a liner for an open riser. In the Washburn patent the open riser is located above the cast article with the frangible material extending along the sides and bottom of the riser.

A prior art closed feeder head is shown in the Krzyzanowski U.S. Pat. No. 3,295,175. Krzyzanowski shows a spherical feeder head made of a cellular material which mounts on a peg in the wood pattern. The spherical feeder head is made of expanded cellular polystyrene. When the hot metal contacts the polystyrene, the polystyrene gasifies producing space for expansion of metal into the riser during the casting process. One of the problems with the cellular spherical feeder is that sand particles become embedded in the cellular material during molding. During gasification of the cellular material, the same particles are freed and begin to work their way down into the casting thus weakening the casting.

BRIEF DESCRIPTION OF THE DRAWING

FIG. 1 shows a sectional view of the present invention in a sand mold;

FIG. 2 shows a sectional view of a constricting collar; and

FIG. 3 shows the sand mold with molten metal therein.

BRIEF SUMMARY OF THE INVENTION

Briefly, the present invention comprises a two-part riser mold pattern with at least one part destroyed by the molten metal while the second part improves the flow of molten into the mold while providing a cleaner casting and a means for reducing the metal neck between the riser and the casting.

DESCRIPTION OF THE PREFERRED EMBODIMENT

Referring to the drawing, FIG. 1 shows a two-part mold consisting of the cope 11 and a drag 12 with a spherical feeder head 13 and a collar 16 located therein. Spherical feeder head 13 comprises a gasible material such as expanded cellular polystyrene. By gasible it is meant that the material converts from the solid state to the gaseous state when contacted by hot metal. Head 13 has a conical dimple 14 at the top and a recess 15 at the bottom which fits on the pattern used to make the sand mold. It is believed the conical point functions to concentrate the heat at the point and thus retard skin formation on the molten metal, thus allowing pressure equalization between the riser and the cast article. Located at the bottom of the spherical feeder 13 is collar 16 which abuts against the casting opening 17. Collar 16 is typically made from a ceramic material which can be broken on impact but does not gasify when contacted by the metal. Other materials which are frangible and heat conducting can also be used for collar 16.

Collar 16 is located on top of casting opening 17 which is to receive the hot metal. Collar 16 has a slight outward draft or upward diverging section to prevent collar 16 from falling into opening 17. Collar 16 also contains a top lip that prevents upward displacement of collar 16 by the hot metal flowing upward through collar 16. Collar 16 which is shown partially in section in FIG. 3 has a smooth surface 20 which abuts against the casting opening to form a part of the mold for the casting. A thin lip 22 extends radially inward to produce a small opening for metal flow through collar 16. As metal flows upward through collar 22 the top edge of collar 20 that abuts against the sand mold prevents the metal flow from displacing the collar as the metal feeds into the recess.

The combination of the collar 16 and the gasible riser head 13 have been found to coact to improve the casting, that is, the gasification of the spherical heads which normally releases loose sand particles which fall downward along the walls into the mold has been virtually eliminated. It has been discovered the coaction of the metal flow through the collar 16 and the top edge 21 coact to catch and trap sand particles to prevent them from contaminating the casting. It is believed that this phenomenon is brought about by the metal flow pattern through the center of collar 16 while there is an area of no flow along the walls.

FIG. 3 shows molten metal 18 extending into riser cavity 9 formerly occupied by gasible feeder riser 13. Collar 16 remains fixed in place in sand mold 11. As the metal cools the casting shrinks allowing gravity feeding of metal from cavity 9 into casting 18 thus insuring a solid casting. The relatively thin lip 22 of collar 16 allows good thermal conduction therethrough to thereby maintain the metal in a molten state for sufficiently long a time so that shrinkage voids are filled in the casting.

I claim:

1. A two-part riser for inserting into a sand mold to produce a riser cavity comprising:

a first portion formed of a gasible material that gasifies when contacted by molten metal, said first portion having sufficient volume so that upon gasification of said first portion produces a riser cavity for molten metal;

a second portion including a collar, said collar comprised of a frangible nongasible material, said collar located at the entrance to said riser so that molten metal flows through said collar into the riser cavity produced by gasification of said first portion; and a retaining lip located on said collar for preventing sand from falling into the casting during the gasification of said first portion.

2. The invention of claim 1 wherein said collar forms a part of the pattern for a cast article.

3. The invention of claim 2 wherein said collar has a diverging section to prevent the collar from falling into a casting mold.

4. The invention of claim 3 wherein said collar has a top edge that projects beyond said first portion to prevent upward displacement of said collar.

5. The invention of claim 4 wherein said first portion comprises cellular polystyrene.

6. The invention of claim 5 wherein said collar has a central opening that extends radially inward from the side of said riser cavity.

* * * * *